US011190895B2

(12) United States Patent
Hattori et al.

(10) Patent No.: US 11,190,895 B2
(45) Date of Patent: Nov. 30, 2021

(54) SIGNAL PROCESSING APPARATUS, SIGNAL PROCESSING SYSTEM, SIGNAL PROCESSING METHOD, AND RECORDING MEDIUM FOR CHARACTERISTICS IN SOUND LOCALIZATION PROCESSING PREFERRED BY LISTENER

(71) Applicant: SHARP KABUSHIKI KAISHA, Sakai (JP)

(72) Inventors: Hisao Hattori, Sakai (JP); Takeaki Suenaga, Sakai (JP); Takuto Ichikawa, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/962,683

(22) PCT Filed: Dec. 21, 2018

(86) PCT No.: PCT/JP2018/047322
§ 371 (c)(1),
(2) Date: Jul. 16, 2020

(87) PCT Pub. No.: WO2019/142604
PCT Pub. Date: Jul. 25, 2019

(65) Prior Publication Data

US 2021/0092544 A1 Mar. 25, 2021

(30) Foreign Application Priority Data

Jan. 19, 2018 (JP) ..... JP2018-007452

(51) Int. Cl.
*H04S 7/00* (2006.01)

(52) U.S. Cl.
CPC ..... *H04S 7/301* (2013.01); *H04S 7/302* (2013.01); *H04S 7/307* (2013.01); *H04S 2420/01* (2013.01)

(58) Field of Classification Search
None
See application file for complete search history.

(56) References Cited

U.S. PATENT DOCUMENTS

2009/0214045 A1* 8/2009 Fukui ..... H04S 3/004 381/17
2011/0142244 A1* 6/2011 Obata ..... H04S 7/302 381/17
2017/0238111 A1* 8/2017 Kitazawa ..... H04S 7/304 381/17
2018/0176709 A1 6/2018 Konishi et al.

FOREIGN PATENT DOCUMENTS

JP 2017-041766 A 2/2017

* cited by examiner

*Primary Examiner* — James K Mooney
(74) *Attorney, Agent, or Firm* — ScienBiziP, P.C.

(57) ABSTRACT

Appropriate audio processing is selected. A signal processing apparatus includes: an audio signal output unit that outputs a plurality of test sounds in a superimposed manner; a controller that prompts a listener to select a test sound having a specific sense of localization out of the plurality of test sounds; a receiver that acquires results of the selection made by the listener; and an audio signal processing unit that performs audio signal processing associated with the results of the selection on an input signal.

12 Claims, 5 Drawing Sheets

SIGNAL PROCESSING APPARATUS, SIGNAL PROCESSING SYSTEM, SIGNAL PROCESSING METHOD, AND RECORDING MEDIUM FOR CHARACTERISTICS IN SOUND LOCALIZATION PROCESSING PREFERRED BY LISTENER

TECHNICAL FIELD

The disclosure relates to a signal processing technique enabling selection of audio processing to be performed on an input signal.

The present application claims priority to Japanese Patent Application 2018-007452 filed in Japan on Jan. 19, 2018, of which contents are incorporated herein by reference.

BACKGROUND ART

In recent years, transmission of surround signals such as 5.1 surround sound, as well as monaural signals and stereo signals, on broadcast waves that are transmitted from television stations has become possible. Accordingly, reproduction of such a sound field as to surround listeners has been becoming possible even at homes. The 5.1 surround signal is a signal for integrally driving a total of six speakers, which are a center speaker located at the center front, right and left speakers located on the right and left sides of the center speaker in a bilaterally symmetrical manner, right and left speakers located behind a listener, and a speaker for low frequency sounds. Reproduction of appropriately produced 5.1 surround signals by using an appropriately installed speaker system for 5.1 surround sound reproduction enables expression as if sound sources are reproduced around a listener.

In addition, in recent years, a 22.2 multichannel sound system has been proposed. In the system, speakers are also located in the height direction, which have not hitherto been located. Specifically, a total of 22 speakers, which are nine speakers in an upper layer (top layer), ten speakers in an intermediate layer (middle layer) at height of a listener's ears, and three speakers in a low layer (bottom layer), and two speakers for low frequency sounds are used. Appropriate reproduction of the speakers of the 22.2 multichannel sound system enables reproduction of a sound field that entirely surrounds a listener, including the height direction.

Not only these methods, various multi-channel audio systems using a plurality of speakers have been proposed. However, the recommended location of the speakers specified regarding such multi-channel audio does not always fit actual living environments of listeners. In particular, it is difficult to implement location of speakers in which speakers are mounted in an upper layer as that recommended in the 22.2 multichannel sound system.

In view of this, a technique (binaural reproduction technique) of performing audio signal processing on audio and reproducing the audio made to reflect appropriate audio characteristics via headphones to virtually achieve sound localization at recommended speaker positions has been proposed. A technique (transaural reproduction technique) of performing audio signal processing on audio and reproducing audio made to reflect appropriate audio characteristics by using speakers located at positions different from recommended speaker positions to virtually achieve sound localization at recommended speaker positions, for example, has also been proposed. Note that the audio characteristics refer to transfer characteristics of audio from a specific position in an actual space to both the ears of a listener. In these techniques, for example, transfer characteristics are measured and are used as head-related transfer functions.

By using head-related transfer functions representing variation of sounds caused by the shape of pinnae or the like as transfer functions, a direction that a listener perceives sound localization can be controlled. However, the shape of pinnae or the like significantly differs from listener to listener, and accordingly, head-related transfer functions representing variation of sounds caused by the shape of pinnae or the like also significantly differ from listener to listener. In other words, optimal head-related transfer functions are different for each individual listener. Thus, using head-related transfer functions of others does not always lead to perception of sound localization in directions as with others.

To address such issues, a technique of determining optimal head-related transfer functions for a listener out of a plurality of head-related transfer functions has been proposed (PTL 1). In the technique according to PTL 1, a listener listens to a plurality of audio made to reflect head-related transfer functions different from each other one by one, and the listener points a direction of sound localization of the audio that the listener listened, and optimal head-related transfer functions for the listener are thereby determined.

CITATION LIST

Patent Literature

PTL 1: JP 2017-41766 A (published on Feb. 13, 2017)

SUMMARY

Technical Problem

However, according to the original findings of the inventors of the present invention, it is difficult to select appropriate audio signal processing in the conventional techniques.

The disclosure is made in view of such circumstances, and has a main object to provide a signal processing technique that enables more appropriate selection of audio signal processing to be performed on an input signal.

Solution to Problem

To solve the problems described above, a signal processing apparatus according to one aspect of the present invention includes: an output unit configured to output a plurality of test sounds in a superimposed manner; a selection processing unit configured to prompt a listener to select a test sound having a specific sense of localization out of the plurality of test sounds; an acquisition unit configured to acquire results of the selection made by the listener; and an audio signal processing unit configured to perform audio processing associated with the results of the selection on an input signal.

A signal processing method according to one aspect of the present invention includes: an output step of using a signal processing apparatus to output a plurality of test sounds in a superimposed manner; a selection processing step of using the signal processing apparatus to prompt a listener to select a test sound having a specific sense of localization out of the plurality of test sounds; an acquisition step of using the signal processing apparatus to acquire results of the selection made by the listener; and an audio processing step of using the signal processing apparatus to perform audio processing associated with the results of the selection on an input signal.

Advantage Effects of Disclosure

According to one aspect of the present invention, audio processing to be performed on an input signal can be more appropriately selected.

DESCRIPTION OF EMBODIMENTS

First Embodiment

A signal processing apparatus 20, a signal processing system 1, and a method of controlling a signal processing apparatus according to one embodiment (first embodiment) of the present invention will be described below with reference to FIG. 1 and FIG. 2.

Signal Processing System 1

Figure 1:
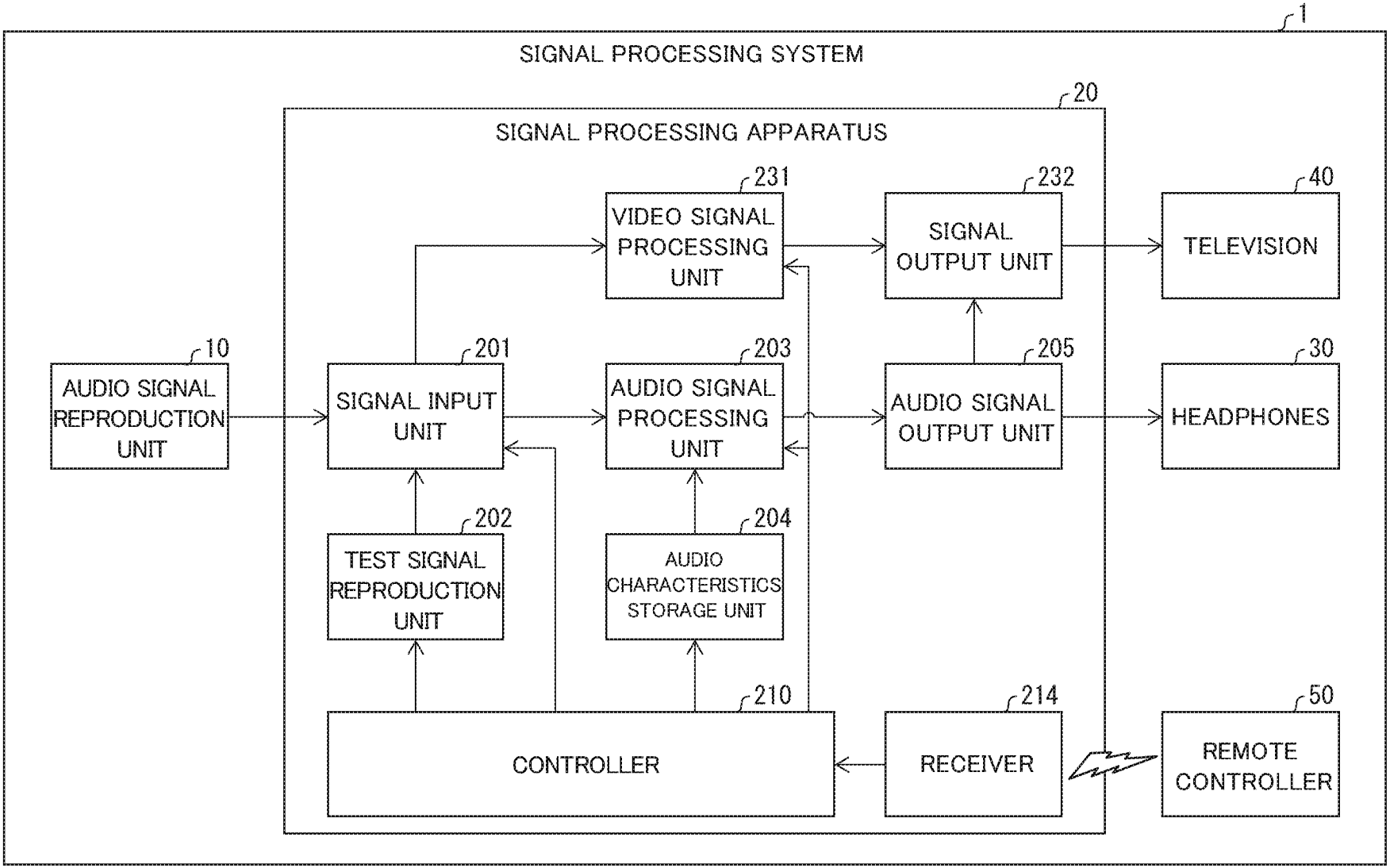
FIG. 1 is a block diagram illustrating a configuration example of a signal processing system according to a first embodiment of the present invention.

FIG. 1 is a block diagram illustrating a configuration of a signal processing system 1 according to the present embodiment. The signal processing system 1 according to the present embodiment includes an audio signal reproduction unit 10, a signal processing apparatus (sound localization processing characteristics determination apparatus) 20, one or more sets of headphones (sound output apparatuses) 30, a television (display device) 40, and a remote controller 50. As the headphones 30, publicly known headphones can be used as long as the headphones output a plurality of test sounds and sounds of audio signals (input signals) that have been subjected to audio signal processing, and thus description thereof will be herein omitted. In a similar manner to the headphones 30, as the television 40 and the remote controller 50 as well, publicly known televisions and remote controllers can be used, and thus description thereof will be herein omitted.

Note that, in the example described above, the signal processing system 1 includes a television 40 and a remote controller 50. However, the present embodiment is not limited to the above example. In the present embodiment, the signal processing system 1 is only required to include a component that outputs test sounds to a listener, and a component that receives operation input from a listener and outputs the operation input to the signal processing apparatus 20. For example, the signal processing system 1 may include a smartphone 51 (not illustrated) having functions of both the television 40 and the remote controller 50, instead of the television 40 and the remote controller 50. The signal processing system 1 need not include the television 40.

Details of the audio signal reproduction unit 10 and the signal processing apparatus 20 will be described below.

Audio Signal Reproduction Unit 10

The audio signal reproduction unit 10 outputs signals (input signals) to a signal input unit 201 of the signal processing apparatus 20. Examples of the input signal include a monaural signal, a two-channel stereo signal, and a three or higher channel surround signal. It is preferable that the input signal be a three or higher channel surround signal. Examples of the three or higher channel surround signal include signals of 5.1, 7.1, 22.2, etc. Examples of a format of the input signal include a digital signal format and an analog signal format. It is preferable that the format of the input signal be a digital signal format, as it reduces the amount of processing in the signal processing apparatus 20. It is preferable that the audio signal reproduction unit 10 output signals via an HDMI (trade name). A configuration that the audio signal reproduction unit 10 outputs signals via an HDMI (trade name) allows for substantially simultaneous output of an audio signal and a video signal to the signal input unit 201.

Signal Processing Apparatus 20

The signal processing apparatus 20 processes input signals, such as an audio signal and a video signal. As illustrated in FIG. 1, the signal processing apparatus 20 includes a signal input unit 201, a test signal reproduction unit 202, an audio signal processing unit 203, an audio characteristics storage unit 204, an audio signal output unit (output unit) 205, a controller (selection processing unit) 210, a receiver (acquisition unit) 214, a video signal processing unit 231, and a signal output unit 232.

Signal Input Unit 201

The signal input unit 201 outputs signals (input signals) input from the audio signal reproduction unit 10 to the audio signal processing unit 203 and the video signal processing unit 231.

For example, in one aspect, the signal input unit 201 receives input of input signals from the audio signal reproduction unit 10 via an HDMI (trade name). The signal input unit 201 demultiplexes an audio signal and a video signal included in the input signals, and then outputs the audio signal to the audio signal processing unit 203 and outputs the video signal to the video signal processing unit 231.

The signal input unit 201 may be provided with a signal switch function of selecting input signals to be a target of processing in the signal processing apparatus 20 out of a plurality of signals input to the signal input unit 201. In this case, for example, the signal input unit 201 may switch the input signals, in accordance with a command from the controller 210. The signal input unit 201 may be provided with a function of converting input signals being analog signals into digital signals.

Test Signal Reproduction Unit 202

The test signal reproduction unit 202 stores a plurality of test signals in an internal or external storage unit, and reproduces test signals specified by the controller 210. The test signal reproduction unit 202 outputs reproduced test signals to the signal input unit 201.

Audio Signal Processing Unit 203

The audio signal processing unit 203 processes audio signals input from the signal input unit 201. Specifically, the audio signal processing unit 203 performs processing of making the audio signals (input signals) that are input from the signal input unit 201 reflect audio characteristics (characteristics in sound localization processing) that are provided from the audio characteristics storage unit 204 (processing of convolving the audio signals with audio characteristics). In one aspect, the audio signal processing unit 203 receives input of audio characteristics from the audio characteristics storage unit 204 in the form of impulse responses. The audio signal processing unit 203 convolves input signals input from the signal input unit 201 with the impulse responses. Alternatively, in another aspect, the audio signal processing unit 203 may receive input of audio characteristics from the audio characteristics storage unit 204 in the form of parameters of IIR filters. The audio characteristics storage unit 204 may make the input signals reflect parameters of the infinite impulse response (IIR) filters.

Specifically, the audio signal processing unit 203 sets a plurality of audio characteristics provided from the audio characteristics storage unit 204 in respective convolvers. The audio signal processing unit 203 convolves a plurality of test signals input from the signal input unit 201 with audio signals different from each other in respective convolvers. The audio signal processing unit 203 outputs a plurality of audio signals convolved with a plurality of respective audio characteristics to the audio signal output unit 205.

Audio Characteristics Storage Unit 204

The audio characteristics storage unit 204 stores a plurality of audio characteristics in an internal or external storage unit, and provides the audio signal processing unit 203 with audio characteristics specified by the controller 210. For example, the audio characteristics storage unit 204 provides a plurality of audio characteristics in the form of impulse responses, parameters of IIR filters, or the like.

In the present embodiment, the audio characteristics provided by the audio characteristics storage unit 204 are head-related transfer functions (HRTFs). In addition to the above-mentioned plurality of head-related transfer functions, the audio characteristics storage unit 204 may further provide audio characteristics used for audio correction.

Audio Signal Output Unit 205

The audio signal output unit 205 outputs a plurality of test sounds made to reflect audio characteristics different from each other in a superimposed manner. In one example, the audio signal output unit 205 outputs a plurality of test sounds whose audio signals are made to reflect head-related transfer functions different from each other in a superimposed manner.

Here, the audio signal output unit 205 converts the format of the plurality of audio signals from digital signals to analog signals, and outputs a plurality of test sounds to a listener via the headphones 30. Moreover, the audio signal output unit 205 may further perform various types of processing such as downmixing processing and volume adjustment processing on the audio signals, and output the audio signals to the signal output unit 232.

Controller 210

The controller 210 integrally controls each unit of the signal processing apparatus 20. In one aspect, the controller 210 causes the test signal reproduction unit 202 to reproduce a plurality of different test signals, causes the audio characteristics storage unit 204 to provide a plurality of audio characteristics different from each other, and causes the audio signal processing unit 203 to generate audio signals that are obtained by making the plurality of test signals reflect the audio characteristics different from each other. The controller 210 causes the video signal processing unit 231 to generate a screen that allows a listener to select a test sound having a specific sense of localization out of a plurality of test sounds.

Receiver 214

The receiver 214 acquires (receives) results of selection of a test sound made by the listener.

Video Signal Processing Unit 231

The video signal processing unit 231 processes video signals input from the signal input unit 201. Specific examples of processing performed by the video signal processing unit 231 include processing of superimposing a user interface image on video signals and processing of changing amplitude of video signals.

The video signal processing unit 231 generates a screen that allows a listener to select a test sound having a specific sense of localization out of a plurality of test sounds, in accordance with a command from the controller 210. The video signal processing unit 231 outputs processed or generated video signals to the signal output unit 232.

Signal Output Unit 232

The signal output unit 232 combines video signals input from the video signal processing unit 231 and audio signals input from the audio signal output unit 205, and outputs the combined signals to the outside of the signal processing apparatus 20, such as the television 40, in the form of HDMI (trade name) signals. The television 40 that has received the HDMI (trade name) signals displays a video based on the signals, and outputs audio based on the signals.

Operations of Signal Processing System 1

A series of operations performed by the signal processing system 1 will be described below.

First, the receiver 214 receives a command to perform an audio test from a listener via the remote controller 50. In response to the command, the controller 210 performs control so that the signal input unit 201 processes test signals input from the test signal reproduction unit 202, instead of input signals input from the audio signal reproduction unit 10. The controller 210 controls the video signal processing unit 231 so that the video signal processing unit 231 superimposes display necessary for the audio test on video signals input from the signal input unit 201.

Next, the controller 210 causes the test signal reproduction unit 202 to reproduce a plurality of test sounds and output the reproduced test sounds to the audio signal processing unit 203, and causes the audio characteristics storage unit 204 to provide the audio signal processing unit 203 with a plurality of audio characteristics. Then, the controller 210 causes the audio signal processing unit 203 to make the plurality of test sounds reflect the audio characteristics different from each other, and to output obtained results to the audio signal output unit 205.

The audio signal output unit 205 performs various types of processing such as downmixing processing and volume adjustment processing on the plurality of audio signals output from the audio signal processing unit 203 according to an output format, and outputs the obtained results to the headphones 30 or the signal output unit 232. Specifically, when the audio signal output unit 205 outputs the audio signals to the headphones 30, the audio signal output unit 205 downmixes the audio signals into two-channel signals and outputs the downmixed two-channel signals.

Audio Test According to Signal Processing System 1

Procedure of Audio Test

A procedure of an audio test (signal processing method) performed using the signal processing system 1 will be described below.

First, the receiver 214 of the signal processing apparatus 20 receives a command to perform an audio test from a listener via the remote controller 50. In response to this, the signal processing apparatus 20 enters a test mode. The signal processing apparatus 20 that has entered the test mode issues a command so as to prompt the listener to select a test sound that is perceptible to the listener via the television 40. The receiver 214 receives information of a preferred test sound selected by the listener via the remote controller 50. The controller 210 that has acquired the information of the preferred test sound from the receiver 214 starts an audio test. A preferred test sound selected by a listener will be described later.

First Stage Test

In the first stage test, the signal processing apparatus 20 outputs a plurality of test sounds convolved with a plurality of respective audio characteristics to a listener in a superimposed manner. The audio signal processing unit 203 of the signal processing apparatus 20 generates the plurality of test sounds by convolving audio signals with all of a plurality of audio characteristics stored in the audio characteristics storage unit 204 separately in a plurality of times. The audio signal output unit 205 of the signal processing apparatus 20 outputs the plurality of test sounds to a listener via the headphones 30 in a superimposed manner. For example, it is herein assumed that 20 types of audio characteristics are stored in the audio characteristics storage unit 204. In this case, the audio signal output unit 205 outputs 4 types of test sounds to a listener in each test in a superimposed manner (output step). In this manner, the listener can hear test sounds convolved with all of the 20 types of audio characteristics stored in the audio characteristics storage unit 204 with five tests.

Here, to output a plurality of test sounds to a listener in a superimposed manner means to reproduce a plurality of test sounds substantially at the same time. That is to say, if there are two test sounds, to output a plurality of test sounds to a listener in a superimposed manner in this case means to start reproduction of the two test sounds substantially at the same time. In a case where the lengths of the two test sounds are different from each other, the test sound with the shorter length of audio may be repeated, or the test sound with the longer length of audio may be shortened to have the same length as the shorter test sound. If test sounds are intermittent sounds, the test sounds need not be necessarily reproduced substantially at the same time, and at least a part of the test sounds may be output in a superimposed manner.

The controller 210 prompts the listener to select a test sound having a specific sense of localization out of the above-mentioned plurality of test sounds (selection processing step). In one aspect, the controller 210 prompts the listener to select a test sound that is located at a position outside of the head out of the above-mentioned plurality of test sounds. In another aspect, the controller 210 prompts the listener to select a test sound that is located in a predetermined direction (for example, behind) outside of the head out of the above-mentioned plurality of test sounds. In another aspect, when the same test sounds are located at a plurality of localization positions, the controller 210 prompts the listener to select a test sound depending on a relation of the localization positions among the same test sounds (for example, imbalance in the localization positions in the test sounds or distances between the localization positions in the test sounds) out of the above-mentioned plurality of test sounds.

For example, the listener pushes any one of the button(s) of the remote controller 50 to select a test sound that has a specific sense of localization and transmit the selected test sound to the receiver 214. The receiver 214 receives (acquires) results of the selection made by the listener (acquisition step). The audio signal processing unit 203 performs audio signal processing associated with the results of the selection on audio signals (input signals) input to the audio signal processing unit 203 (audio processing step). Through the operation above, characteristics in sound localization processing preferred by a listener can be easily determined. Note that, without sound localization, a listener feels that test sounds are heard from positions near the headphones or the head, or feels that test sounds are heard from positions both near the head and outside of the head, for example.

In the following, the 20 types of audio characteristics stored in the audio characteristics storage unit 204 are referred to as audio characteristics 1, 2, 3, . . . , 20, and the test sounds to be output to the listener are referred to as test sounds 1, 2, 3 . . . . The audio signal output unit 205 outputs a plurality of test sounds 1, 2, 3 . . . made to reflect any one of the audio characteristics 1 to 20 to the listener via the headphones 30 separately in a plurality of times.

For example, in a case where test sounds selected by the listener in the first test are a test sound 2 made to reflect audio characteristics 2 and a test sound 4 made to reflect audio characteristics 4, the controller 210 records the test sounds 2 and 4 as candidates for preferred test sounds.

Next, in a case where a test sound selected by the listener in the second test is a test sound 5 made to reflect audio characteristics 5, the controller 210 adds the test sound 5 to the candidates for preferred test sounds.

The signal processing apparatus 20 continues the audio test in a similar manner. If the listener feels that none of the test sounds is located at a position outside of the head, the audio signal output unit 205 outputs a set of 4 types of test sounds made to reflect other 4 types of audio characteristics to the listener via the headphones 30 in a superimposed manner. If the preferred test sounds are test sounds 2, 4, 5, and 13 immediately after completion of the fifth test, the controller 210 determines that candidates of preferred audio characteristics are the 4 types of audio characteristics 2, 4, 5, and 13 out of the 20 types of audio characteristics.

Second Stage Test

Next, in the second stage test, the signal processing apparatus 20 prompts the listener to select a test sound having more preferred audio characteristics out of the candidates of the preferred audio characteristics from the first stage test that are likely to be suitable for the listener, and the receiver 214 can receive results of the selection made by the listener. As a result, audio characteristics more preferred by the listener can be easily determined.

The second stage test will be described below in detail. In a manner similar to the above, the audio signal output unit 205 outputs 4 types of test sounds made to reflect 4 types of audio characteristics to the listener via the headphones 30 in a superimposed manner. The controller 210 prompts the listener to select a test sound that is more accurately located at a specific localization position (for example, behind), and the receiver 214 receives results of the selection made by the listener. For example, it is herein assumed that the preferred test sounds in the first stage test are the test sounds 2, 4, 5, and 13. In this case, the audio signal output unit 205 outputs the test sounds 2, 4, 5, and 13 to the listener in a superimposed manner, the controller 210 prompts the listener to select a test sound that is located at a specific localization position more accurately out of those test sounds, and the receiver 214 receives results of the selection made by the listener. The controller 210 determines that the audio characteristics in the selected test sound are more preferred audio characteristics.

Third Stage Test

The signal processing apparatus 20 may perform the third stage test in a case where there are a plurality of audio characteristics determined as more preferred audio characteristics after completion of the second stage test. In the third stage test, a test is performed with test sounds being made to reflect different audio characteristics.

For example, it is herein assumed that the candidates of the preferred audio characteristics after completion of the second stage test are the audio characteristics 2 and the audio characteristics 4. In this case, in the third stage test, first, the audio signal output unit 205 outputs a test sound 1' made to reflect the audio characteristics 2 and a test sound 4' made to reflect the audio characteristics 4 to the listener in a superimposed manner. If the listener selects the test sound 1', the controller 210 gives a point to the audio characteristics 2 reflected in the test sound 1'. The audio signal output unit 205 continues to output test sounds made to reflect different audio characteristics to the listener until the audio signal output unit 205 has the listener hear all the test sounds made to reflect respective audio characteristics. The controller 210 compares points of audio characteristics, and determines that audio characteristics having the highest point are the optimal audio characteristics.

Owing to such a configuration as described above that the audio test is performed with test sounds being made to reflect different audio characteristics, compatibility between head-related transfer functions in audio characteristics and test sounds can be made to have a smaller impact on the effects as to how the sound is heard, and preferred audio characteristics can be determined with higher accuracy.

Note that, in the example described above, the audio test is performed with test sounds not being made to reflect different audio characteristics until the third stage test. However, the present embodiment is not limited to the above example. In the present embodiment, the audio test may be performed with test sounds being made to reflect different audio characteristics in the second stage test.

Effects Produced by Audio Test According to Signal Processing System 1

According to the audio test according to the signal processing system 1 described above, preferable effects as described below are produced, in comparison with conventional audio tests.

There have hitherto been audio tests in which a listener selects specific audio characteristics out of a plurality of audio characteristics such as head-related transfer functions. However, with the conventional audio test as disclosed in PTL 1, a listener is required to point a direction of sound localization, which takes time of the listener and puts a burden on the listener. There is a case where audio characteristics do not suit a listener, or a listener does not fully understand the concept of localization or perceive the difference between sound localization inside of the head and sound localization outside of the head. In this case, it is difficult for a listener to accurately point a direction of sound localization. A large-scale apparatus provided with a function of detecting a direction pointed by a listener in response to the listener's perception of sound localization is needed, which increases costs. In the conventional audio test as disclosed in PTL 1, a listener listens to a plurality of test sounds made to reflect a plurality of audio characteristics such as head-related transfer functions one by one. As mentioned above, when a listener listens to a plurality of test sounds a plurality of times separately at intervals one by one, the listener feels that each test sound has its pros and cons and finds it difficult to select a test sound made to reflect preferable audio characteristics. Particularly when test sounds have a plurality of audio characteristics that suit a listener, it is even more difficult for the listener to select more preferable audio characteristics out of the audio characteristics.

In contrast, in the audio test according to the signal processing system 1 according to the present embodiment, a plurality of test sounds made to reflect a plurality of audio characteristics are output to a listener in a superimposed manner, and thus the listener can easily select which audio characteristics are preferable. In the audio test according to the signal processing system 1, a listener only needs to select which test sound out of a plurality of test sounds has a specific sense of localization. For example, in the audio test according to the signal processing system 1 according to the present embodiment, test sounds are output so that the test sounds are located behind the listener. In this case, when the listener feels that a test sound is located behind the listener, the listener only simply needs to select the test sound that is heard from behind the listener. Owing to this configuration, even a listener who is not accustomed to confirming sound localization can easily give an answer. As a result, according to the audio test according to the signal processing system 1 according to the present embodiment, audio characteristics preferred by a listener can be easily determined, in comparison with the conventional audio test as disclosed in PTL 1.

First Modification

Note that, in the example described above, the audio signal output unit 205 outputs the test sounds 1, 2, 3 . . .

made to reflect the audio characteristics 1 to 20 as appropriate. However, the present embodiment is not limited to the above example. In the present embodiment, the audio signal output unit 205 may output a plurality of test sounds, with numbers of audio characteristics to be reflected in which test sounds being determined in advance.

For example, the audio signal processing unit 203 may generate a plurality of test sounds by making the test sounds 1, 2, 3 . . . reflect the audio characteristics 1 to 20 sequentially in ascending order, respectively. Further, in the first test in the first stage, the audio signal output unit 205 outputs the test sound 1 made to reflect the audio characteristics 1, the test sound 2 made to reflect the audio characteristics 2, the test sound 3 made to reflect the audio characteristics 3, and the test sound 4 made to reflect the audio characteristics 4 in a superimposed manner. In a similar manner, in the second test, the audio signal output unit 205 outputs the test sound 5 made to reflect the audio characteristics 5, the test sound 6 made to reflect the audio characteristics 6, the test sound 7 made to reflect the audio characteristics 7, and the test sound 8 made to reflect the audio characteristics 8 in a superimposed manner. In a similar manner, the audio signal output unit 205 continues to output a plurality of test sounds that are made to sequentially reflect the first 4 types of the remaining audio characteristics out of the 20 types stored in the audio characteristics storage unit 204. Owing to such a configuration as described above that the audio signal processing unit 203 determines in advance which numbers of audio characteristics are to be reflected in which test sounds and the audio signal output unit 205 outputs a plurality of test sounds, the plurality of test sounds can be output with speed of generating the plurality of test sounds being increased. As a result, the audio test can be completed in shorter time.

Second Modification

In the example described above, the audio signal output unit 205 outputs a plurality of test sounds in a superimposed manner so that localization positions of test sounds located at positions outside of the head of a listener out of test sounds located at positions outside of the head of a listener are all at the same position. However, the present embodiment is not limited to the above example.

In the present embodiment, the audio signal output unit 205 may include a plurality of test sounds that are located at positions outside of the head, and may output a plurality of test sounds in a superimposed manner so that localization positions of the test sounds that are located at positions outside of the head are different from each other. In other words, the controller 210 may set localization positions of the plurality of test sounds so that the localization positions of the test sounds for sound localization are localization positions different from each other.

In this case, it is preferable that the controller 210 set the localization positions of the test sounds for sound localization so as to be located at a plurality of positions, and it is more preferable that the controller 210 set the localization positions to be located at a plurality of perceptually uniform positions for a listener. In other words, it is preferable that test sounds having a specific sense of localization are test sounds that are located at a plurality of positions, and it is more preferable that test sounds are test sounds that are located at a plurality of perceptually uniform positions for a listener. Through the operation above, characteristics in sound localization processing preferred by a listener can be more easily determined. Note that examples of a case in which test sounds are located at a plurality of perceptually uniform positions for a listener include a case in which each of the localization positions at which the test sounds are located and a listener form uniform angles.

Note that the audio signal output unit 205 may output a plurality of test sounds in a superimposed manner so that localization positions are different from each other in any stage test out of the first stage test to the third stage test described above. Note that, if there are a plurality of test sounds that are selected by a listener in the first stage test, it is preferable that the audio signal output unit 205 output the plurality of selected test sounds so that localization positions of the plurality of selected test sounds are different from each other in the test of the second and subsequent stages.

In the first stage test, it is likely that a number of test sounds that are initially not located at positions outside of the head of a listener are included, and accordingly it is likely that satisfactory effects cannot be achieved despite its costs even if a plurality of test sounds are output so that localization positions are different from each other. In contrast, according to the configuration as adopted in the test of the second and subsequent stages that a plurality of test sounds are narrowed down in test sounds located at positions outside of the head of a listener and that the test sounds are output so as to make localization positions of the test sounds different from each other, costs can be further reduced in comparison with a configuration in which localization positions of test sounds are made to be different from each other in the first stage test. Preferable effects owing to the configuration of making localization positions different from each other can be satisfactorily achieved. Preferable effects achieved owing to the configuration of making localization positions different from each other will be described below with reference to specific examples.

For example, it is herein assumed that candidates for preferred audio characteristics after performing the second stage test are the audio characteristics 2 and the audio characteristics 4, and the audio signal processing unit 203 newly generates a test sound 2' made to reflect the audio characteristics 2 and a test sound 4' made to reflect the audio characteristics 4. In this case, the controller 210 sets localization positions at which the test sound 2' is located to upper left and lower left of the listener, and sets localization positions at which the test sound 4' is located to upper right and lower right of the listener. The audio signal output unit 205 outputs the test sound 2' whose localization positions are upper left and lower left of the listener and the test sound 4' whose localization positions are upper right and lower right of the listener in a superimposed manner.

The controller 210 prompts the listener to select a test sound that sounded more natural out of the test sound located on the left side and the test sound located on the right side, and the receiver 214 receives results of the selection from the listener. Here, to sound more natural means having well-balanced upper and lower localization positions in each test sound. Owing to such a configuration as described above that the audio signal output unit 205 performs an audio test in which a plurality of test sounds are output in a superimposed manner so that the same test sounds are located at a plurality of localization positions and a listener selects a test sound having well-balanced localization positions in the same test sounds, the controller 210 can determine preferred audio effects with higher accuracy.

It is herein assumed that the receiver 214 receives an answer from a listener that both the test sound located on the left side and the test sound located on the right side sounded natural. In this case, the controller 210 may prompt a listener to select which test sound, the test sound located on the right side or the test sound located on the left side, is the test sound located at the upper side and the lower side that sounded spread in the height direction. In this manner, more preferred audio characteristics can be determined with higher accuracy.

Note that, in the example described above, the audio signal output unit 205 outputs a plurality of preferred test sounds in a superimposed manner so that preferred test sounds are located at a total of four positions, which are upper and lower positions on the left side and upper and lower positions on the right side. However, the present embodiment is not limited to the above example. For example, if there are four candidates for preferred audio characteristics, the audio signal output unit 205 may output the plurality of test sounds in a superimposed manner so that a plurality of test sounds made to reflect preferred audio characteristics are located at upper and lower positions of each of the front, back, right, and left sides of a listener. If the number of preferred audio characteristics is limited, even if the audio signal output unit 205 outputs a plurality of test sounds located at a total of eight localization positions in a superimposed manner, a listener can select more preferred audio characteristics with high accuracy, in a manner similar to the configuration described above.

Test Sound

The test sound is audio convolved with audio characteristics and is audio to be output to a listener, which is generated by the audio signal processing unit 203. It is preferable that a plurality of test sounds be sounds in which differences of head-related transfer functions in audio characteristics are distinct in each test sound. Specifically, it is preferable that a plurality of test sounds be sounds in which frequency components of a band that easily show differences of head-related transfer functions are widely distributed. More specifically, it is preferable that a plurality of test sounds be sounds in which frequency components are widely distributed in 3.8 kHz to 16 kHz, which is a frequency band used for perception of the vertical angle in terms of human hearing.

It is preferable that the test sounds be audio perceptible to a listener even if a plurality of test sounds are output to the listener in a superimposed manner. Here, it is preferable that a listener be allowed to select a test sound out of a plurality of test sounds so as to be perceptible to individual listeners, because perceptibility differs depending on experience and preference of each individual listener.

Specifically, it is preferable that a plurality of test sounds be test sounds perceptible to a listener that have at least one of a tone color, a scale, a tone sequence pattern, and a localization position being different from one another. In this case, the receiver 214 detects input of a tone color, a scale, a tone sequence pattern, or a localization position from a listener, and acquires a test sound associated with the detected input as results of the selection that are selected as a test sound having a specific sense of localization. In this manner, a test sound can be easily perceived through the use of a tone color, a scale, a tone sequence pattern, or a localization position.

The controller 210 prompts a listener to select any one of sound of a plurality of tone colors, sound of a plurality of scales, sound of a plurality of tone sequence patterns, and sound of a plurality of localization positions and a plurality of test sounds. The receiver 214 detects input of a tone color, a scale, a tone sequence pattern, or a localization position from the listener, and acquires a test sound associated with the detected input as results of the selection. More specifically, the controller 210 gives a command to the video signal processing unit 231 so that the signal output unit 232 causes the television 40 to display candidates for test sound. Then, the controller 210 prompts the listener to select a test sound preferable for the listener out of the candidates for the test sound displayed on the television 40, and the receiver 214 receives results of the selection made by the listener. Specifically, the receiver 214 receives information of the test sound selected by the listener out of the sound of a plurality of tone colors, the sound of a plurality of scales, the sound of a plurality of tone sequence patterns, and the sound of a plurality of localization positions, via the remote controller 50.

Specific examples of the sound of a plurality of tone colors may include sounds of animals. In this case, for example, the audio signal processing unit 203 generates test sound 1: sound of a dog, test sound 2: sound of a cat, test sound 3: sound of a horse, and test sound 4: sound of a pig. Alternatively, the audio signal processing unit 203 may generate test sound 1: bird, test sound 2: pheasant, test sound 3: sparrow, and test sound 4: rooster.

Examples of the sound of a plurality of scales may include a plurality of monotones. In this case, for example, the audio signal processing unit 203 generates test sound 1: do, test sound 2: re, test sound 3: mi, and test sound 4: fa.

Examples of the sound of a plurality of tone sequence patterns may include sound of a plurality of rhythms and sound of a plurality of patterns. More specific examples of the sound of a plurality of rhythms may include a combination of sound of a specific rhythm as a reference and sound of a rhythm different from the rhythm as a reference every several times. In this case, for example, the audio signal processing unit 203 generates test sound 1: sound of a specific rhythm as a reference, test sound 2: sound of a rhythm different from the rhythm as a reference every two beats, test sound 3: sound of a rhythm different from the rhythm as a reference every three beats, and test sound 4: sound of a rhythm different from the rhythm as a reference every four beats.

Examples of the sound of a plurality of localization positions have been described above in the second modification of the first embodiment, and thus description thereof will be herein omitted.

Owing to the configuration as described above that the test sound can be selected out of sounds having frequency components in a wide range, such as sound of a plurality of tone colors, sound of a plurality of scales, and sound of a plurality of tone sequence patterns, selection of a test sound perceptible to a listener in particular out of these test sounds can be prompted. In this manner, for example, if a listener has detailed knowledge of sounds of birds, having the listener select sounds of birds for test sounds allows the listener to select test sounds located at localization positions more easily and with higher accuracy. Having a listener listen to test sounds suited to the listener allows the listener to more easily recognize the effects of audio characteristics reflected in a plurality of test sounds. As a result, accuracy of test results of the audio test can be enhanced and a listener's attention during the audio test can be maintained. A listener can more easily select a test sound located at a localization position, and accordingly the listener can shorten the test time of the audio test.

Localization Position

The localization position is an expectation position outside of the head that is set by the controller 210 and at which a test sound is expected to be located. In other words, the localization position is virtually a position at which a speaker is located, and is an expectation position that is expected that a listener perceives that a test sound has been output from a direction of the localization position. Here, if audio characteristics such as head-related transfer functions are suited to a listener, a position at which the listener perceives sound localization matches the expectation position. When the audio signal output unit 205 outputs a plurality of test sounds via the headphones 30 in a superimposed manner so that the above-mentioned plurality of test sounds are located at different positions based on setting information of the localization position in the controller 210, only a preferred test sound suitable for the listener is located at the localization position. Test sounds not suitable for the listener are located at positions other than the localization position or located at obscure localization positions.

For example, it is herein assumed that the controller 210 sets so that at least one test sound out of a plurality of test sounds made to reflect a plurality of audio characteristics is located behind the listener, and the audio signal output unit 205 outputs the test sound to the listener via the headphones 30 in a superimposed manner. In this case, the listener hears a test sound made to reflect audio characteristics suited to the listener from behind the listener. The listener hears a test sound having audio characteristics not suited to the listener from positions other than behind, that is, from positions inside of the head or from obscure positions such as positions around the head. In this manner, according to the configuration described above, a listener can listen to only a test sound having audio characteristics such as head-related transfer functions suited to the listener from a direction of a localization position. Accordingly, a listener can easily perceive a test sound having audio characteristics suited to the listener and a test sound having audio characteristics not suited to the listener.

Here, with the conventional audio test as disclosed in PTL 1, a listener gives an answer of a direction of sound localization, making it difficult for the listener to give an answer if a position of sound localization is obscure. As a result, a burden is placed on the listener. In contrast, with the audio test according to the signal processing system 1, a listener gives an answer of only a test sound located at a localization position. As a result, a burden on the listener can be reduced. Note that, when a listener listens to test sounds via the headphones 30, the test sounds are generally located inside of the head; however, if audio characteristics reflected in the test sounds are by and large suitable for the listener, the test sounds are located outside of the head and are thus perceptible.

A preferred localization position will be described below with reference to FIG. 2. FIG. 2 is a diagram illustrating a relationship between a listener 100 and localization positions 101 to 108 in an audio test according to the signal processing system 1 according to the present embodiment. It is preferable that the audio signal output unit 205 output test sounds located behind the listener 100, that is, a plurality of test sounds including test sounds located at positions of at least one of the localization positions 104 to 106 out of the localization positions 101 to 108 in FIG. 2, in a superimposed manner. In other words, it is preferable that the controller 210 set the localization position to at least one of the localization positions 104 to 106. In still other words, it is preferable that the test sound having a specific sense of localization be a test sound located behind the head of the listener.

Figure 2:
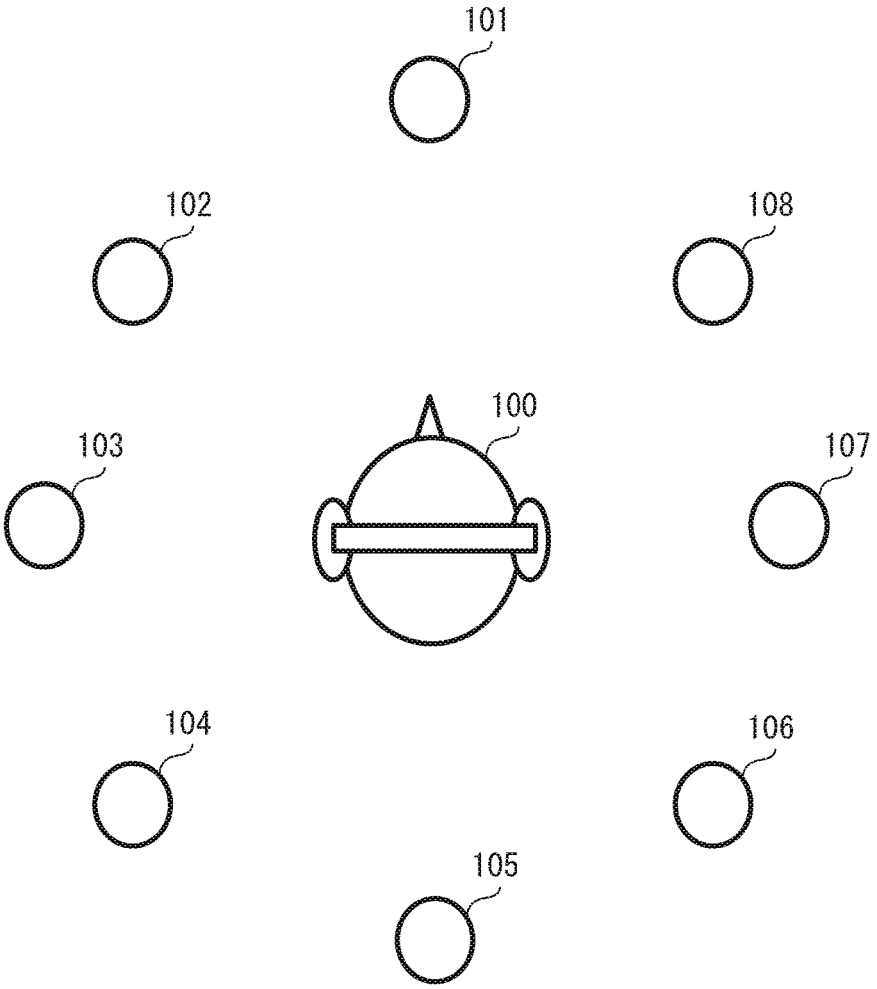
FIG. 2 is a diagram for describing a relationship between a listener and localization positions during an audio test according to the first embodiment of the present invention.

When the audio signal output unit 205 outputs test sounds located at positions the same as the ears of the listener 100 in the front and back direction, for example, positions of at least one of the localization positions 103 and 107 in FIG. 2, the listener 100 is liable to make a wrong judgment that the test sounds are located at positions different from the localization positions set by the controller 210. This is because human ears are positioned at the right and left sides. When the audio signal output unit 205 outputs test sounds whose localization positions are positions in front of the listener 100, for example, the localization positions 101, 102, and 108 in FIG. 2, the listener 100 is susceptible to their sense of sight. In contrast, when the audio signal output unit 205 outputs test sounds located at positions behind the listener 100, for example, the localization positions 104 to 106 in FIG. 2, the listener 100 can perceive that the test sounds are located behind simply due to the influence of audio characteristics such as head-related transfer functions, without the influence of the sense of sight. Owing to such a configuration as described above that the test sound having a specific sense of localization is used as a test sound located behind the head of a listener, characteristics in sound localization processing preferred by the listener can be more easily determined.

Specific Examples of Audio Test

Figure 3:
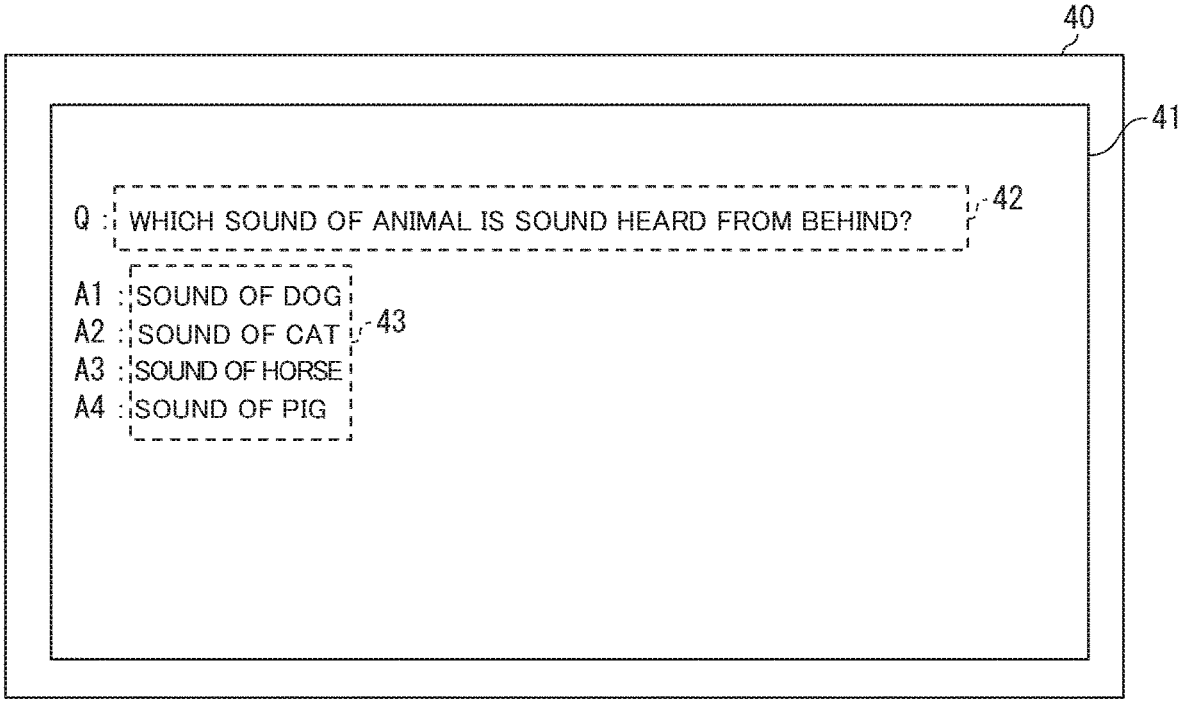
FIG. 3 is a diagram illustrating an example of a display screen during an audio test according to the first embodiment of the present invention.

Specific examples of the audio test will be described below with reference to FIG. 3. FIG. 3 is a diagram illustrating an example of a display screen 41 displayed on the television 40 during the audio test according to the first embodiment. For example, the audio test can be performed as in (1) to (4) described below.

(1) In a case where the listener selects a plurality of sounds of animals as the test sounds, the audio signal processing unit 203 generates test sound 1: sound of a dog, test sound 2: sound of a cat, test sound 3: sound of a horse, and test sound 4: sound of a pig, which are convolved with audio characteristics different from each other. The audio signal output unit 205 outputs the plurality of test sounds including a test sound located behind the listener to the listener in a superimposed manner. The controller 210 prompts selection of a sound of an animal heard from behind the listener. For example, the controller 210 causes the television 40 to display an image used to prompt the listener to select a test sound having a specific sense of localization out of the plurality of test sounds. More specifically, as illustrated in FIG. 3, the controller 210 causes a display screen 41 of the television 40 to display a question 42 asking which sound of an animal is the sound of an animal heard from behind the listener and choices 43 for the answer to the question 42, thereby prompting selection of a sound of an animal heard from behind the listener. The receiver 214 receives results of the selection (choice 43) made by the listener. The signal processing apparatus 20 repeats the audio test described above until the listener listens to test sounds convolved with all of a plurality of types of audio characteristics stored in the audio characteristics storage unit 204.

(2) In a case where the listener selects a plurality of sounds of animals, in particular a plurality of sounds of birds, as the test sounds, the audio signal processing unit 203 generates test sound 1: sound of a bird, test sound 2: sound of a pheasant, test sound 3: sound of a sparrow, and test sound 4: sound of a rooster, which are convolved with audio characteristics different from each other. The audio signal output unit 205 outputs the plurality of test sounds including a test sound located behind the listener to the listener in a superimposed manner. The controller 210 prompts the listener to select which sound of a bird is the sound of a bird heard from behind the listener, in a manner similar to the audio test of (1). The receiver 214 receives results of the selection made by the listener. The signal processing apparatus 20 repeats the audio test in a manner similar to the audio test of (1).

(3) In a case where the listener selects sounds of a plurality of scales as the test sounds, the audio signal processing unit 203 generates test sound 1: do, test sound 2: re, test sound 3: mi, and test sound 4: fa, which are convolved with audio characteristics different from each other. The audio signal output unit 205 outputs the plurality of test sounds including a test sound located behind the listener to the listener in a superimposed manner. The controller 210 prompts the listener to select which sound of a scale is the sound of a scale heard from behind the listener, in a manner similar to the audio tests of (1) and (2). The receiver 214 receives results of the selection made by the listener. The signal processing apparatus 20 repeats the audio test in a manner similar to the audio tests of (1) and (2). Note that the controller 210 may set so that, when sounds of a plurality of scales are heard from behind, the sounds are heard as a chord. When the audio signal output unit 205 has the listener hear test sounds of musical instruments as the test sounds via the headphones 30, it is preferable that the test sounds be audio in which frequency components are distributed in a wide range.

(4) If the listener selects sounds of a plurality of tone sequence patterns as the test sounds, first, the audio signal output unit 205 presents a sound of a certain rhythm as a reference to the listener in advance via the headphones 30. Subsequently, the audio signal processing unit 203 generates test sound 1: sound of a rhythm as a reference, test sound 2: sound of a rhythm different from the rhythm as a reference every two beats, test sound 3: sound of a rhythm different from the rhythm as a reference every three beats, and test sound 4: sound of a rhythm different from the rhythm as a reference every four beats, which are convolved with audio characteristics different from each other. The audio signal output unit 205 outputs the plurality of test sounds including a test sound located behind the listener to the listener in a superimposed manner. The controller 210 prompts the listener to make a selection as to what is the beat of the sound heard from behind the listener, in a manner similar to the audio tests of (1) to (3). The receiver 214 receives results of the selection made by the listener. The signal processing apparatus 20 repeats the audio test in a manner similar to the audio tests of (1) to (3).

Second Embodiment

In the signal processing system 1 described above, the signal processing apparatus 20 has the listener select preferred audio characteristics. However, a function of adjusting parameters of head-related transfer functions in audio characteristics in addition to having a listener select a preferred test sound may be provided, as in a signal processing apparatus 21 of a signal processing system 2 according to the second embodiment.

The signal processing system 2 according to the second embodiment will be described below with reference to FIG. 4. Note that, for the sake of description, components having functions the same as the functions of the components described in the first embodiment are denoted by the same reference signs, and description thereof will be herein omitted.

Signal Processing System 2

Figure 4:
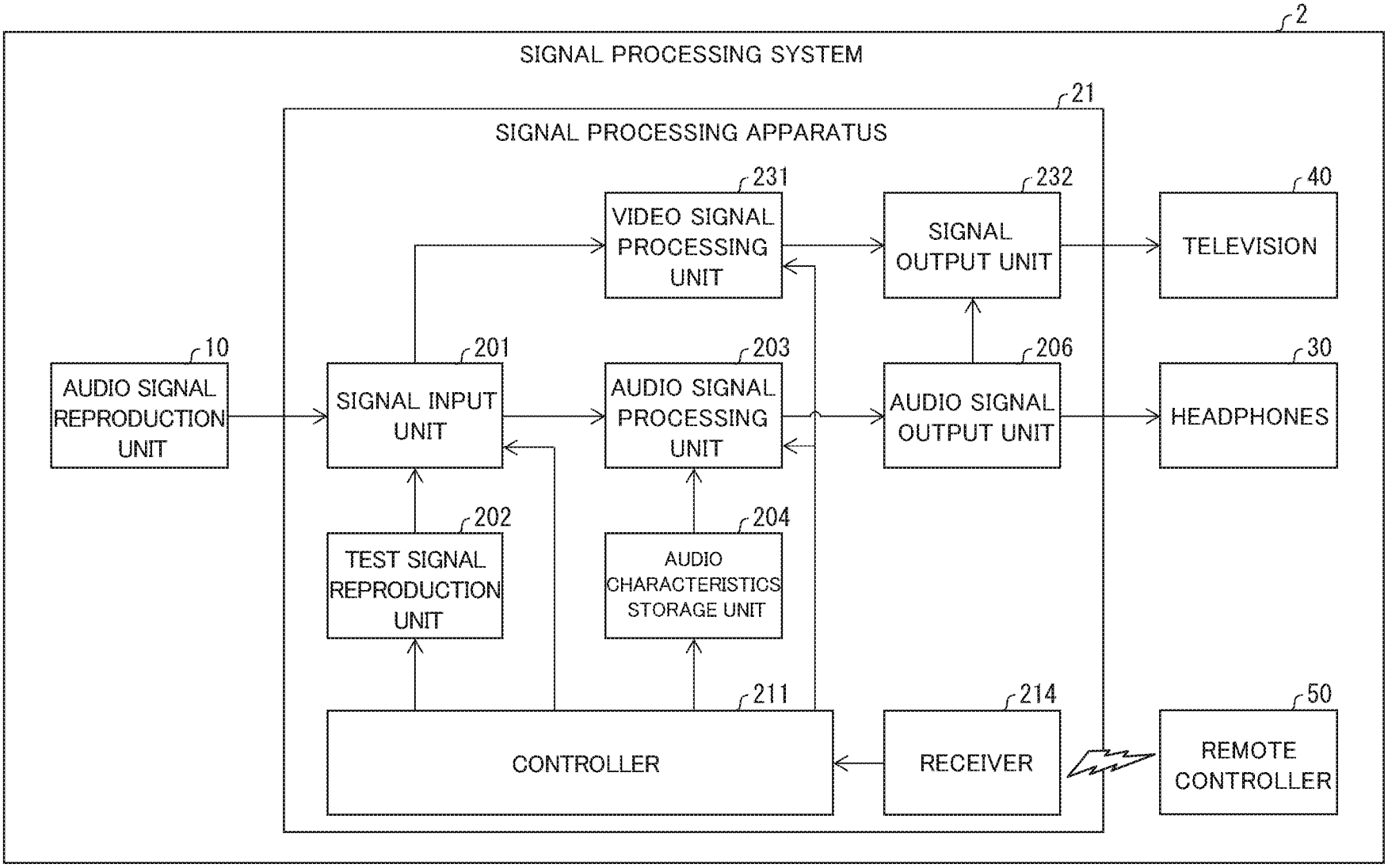
FIG. 4 is a block diagram illustrating a configuration example of a signal processing system according to a second embodiment of the present invention.

FIG. 4 is a block diagram illustrating a main configuration of the signal processing system 2 according to the second embodiment. As illustrated in FIG. 4, the signal processing system 2 includes a signal processing apparatus 21, instead of the signal processing apparatus 20. Other than this configuration, the signal processing system 2 has the same configuration as the configuration of the signal processing system 1.

Signal Processing Apparatus 21

The signal processing apparatus 21 includes a controller 211 instead of the controller 210, and an audio signal output unit 206 instead of the audio signal output unit 205. Other than these configurations, the signal processing apparatus 21 has the same configuration as the configuration of the signal processing apparatus 20.

Controller 211

In addition to the function of the controller 210, the controller 211 adjusts parameters of head-related transfer functions included in audio characteristics and calculates a plurality of audio characteristics. It is preferable that the controller 211 adjust parameters of head-related transfer functions so that the height of the localization positions of a plurality of test sounds output from the audio signal output unit 206 is height different from each of the height of the localization positions of the test sounds before adjustment. Examples of the parameters of head-related transfer functions used herein include parameters of the height and the width of a peak and a notch in a specific frequency band. In this case, for example, it is preferable that the controller 211 adjust the above-described parameters so that the height of the localization positions is height higher than and height lower than the height before adjustment. The height and the width of a peak and a notch in a specific frequency band in head-related transfer functions depend on the shape of pinnae and differ for each individual listener, and the height of localization positions differs as well correspondingly. For this reason, by repeating operation that the audio signal output unit 206 outputs a plurality of test sounds so that the height of localization positions is different height, the controller 211 prompts a listener to select a test sound having a specific sense of localization, and the receiver 214 receives results of the selection from the listener, an adjustment can be made so as to achieve more preferred head-related transfer functions. More specifically, by repeating operation that the controller 211 adjusts the above-described parameters so that the audio signal output unit 206 outputs a test sound of a localization position with high height of a localization position and a test sound with a low localization position in a superimposed manner and adjusts a range of the parameters of preferred head-related transfer functions in response to the answers from the listener, a range of preferred head-related transfer functions can be narrowed down.

Audio Signal Output Unit 206

The audio signal output unit 206 outputs a plurality of test sounds made to reflect a plurality of audio characteristics calculated by the controller 211 to a listener via the headphones 30 in a superimposed manner. For example, as described above, it is preferable that the audio signal output unit 206 output a plurality of test sounds in a superimposed manner so that the heights of localization positions of test sounds located at positions outside of the head of the listener are different.

Audio Test According to Signal Processing System 2

A procedure of an audio test according to the signal processing system 2 will be described below.

The controller 211 of the signal processing apparatus 21 of the signal processing system 2 adjusts head-related transfer functions of at least one of the audio characteristics, and generates a plurality of head-related transfer functions from the head-related transfer functions. The controller 211 outputs the adjusted plurality of head-related transfer functions to the audio characteristics storage unit 204. The audio characteristics storage unit 204 outputs impulse responses including the plurality of head-related transfer functions to the audio signal processing unit 203. The audio signal processing unit 203 reflects the audio signals convolved with the plurality of head-related transfer functions in the test sounds, and outputs a plurality of test sounds convolved with the audio signals to the audio signal output unit 206. The audio signal output unit 206 outputs the plurality of test sounds made to reflect the audio signals to the listener via the headphones 30 in a superimposed manner.

The controller 211 prompts the listener to select a test sound heard from a position closer to the localization position out of the plurality of test sounds made to reflect the adjusted plurality of head-related transfer functions, and the receiver 214 receives results of the selection made by the listener. In this case, it is preferable that the controller 211 have the listener select which test sound is the test sound heard from a height the same as the height of their eyes, for example, at the time of having the listener select a test sound heard from a position closer to a predetermined localization position. This allows the listener to easily picture specific localization positions and more easily make a selection. Owing to such a configuration as described above that the test sound located at a specific height is used as a test sound having a specific sense of localization, characteristics in sound localization processing preferred by the listener can be more easily determined.

For example, it is herein assumed that more preferred test sound immediately after completion of the third stage test according to the first embodiment is the test sound 2 according to the first embodiment. In this case, the controller 211 adjusts the head-related transfer functions so that the audio characteristics 2 reflected in the test sound 2 are audio characteristics 2' and audio characteristics 2". The audio signal output unit 206 outputs a test sound 2' made to reflect the audio characteristics 2' and a test sound 2" made to reflect the audio characteristics 2" to the listener via the headphones 30 in a superimposed manner. The controller 211 prompts the listener to select a test sound heard from a position closer to the localization position out of the test sound 2' and the test sound. The receiver 214 receives results of the selection made by the listener.

For example, it is herein assumed that the listener selects the test sound 2' as the test sound heard from a position close to the localization position. In this case, the controller 211 adjusts the parameters of head-related transfer functions of the audio characteristics 2' reflected in the test sound 2' to audio characteristics 2'-1 with the heights of localization positions of a plurality of test sounds each being height higher than the height of the localization positions before adjustment and audio characteristics 2'-2 with the heights being lower. The audio signal processing unit 203 generates a test sound 2'-1 made to reflect the audio characteristics 2'-1 and a test sound 2'-2 made to reflect the audio characteristics 2'-2. The audio signal output unit 206 outputs the test sound 2'-1 and the test sound 2'-2 in a superimposed manner. The controller 211 prompts the listener to select a test sound heard from a position closer to the localization position out of the test sound 2'-1 and the test sound 2'-2. The receiver 214 receives results of the selection made by the listener.

In this manner, the signal processing apparatus 21 repeats the operation of outputting a plurality of test sounds made to reflect a plurality of audio characteristics with adjusted head-related transfer functions to a listener in a superimposed manner and having the listener select a test sound heard from a position close to the localization position. In this manner, as with the case in the first embodiment, the listener can evaluate a plurality of head-related transfer functions substantially at the same time, and can thus easily and promptly know which of the head-related transfer functions is more preferable. Owing to the configuration as described above that head-related transfer functions are adjusted and audio tests for measuring which of the head-related transfer functions is preferable are performed a plurality of times, an adjustment can be made so as to achieve head-related transfer functions as parameters optimal for the listener.

Note that, in the example described above, the signal processing system 2 performs the audio test of adjusting head-related transfer functions after completion of the third stage test. In the present embodiment, however, the audio test of adjusting head-related transfer functions may be performed at any time. For example, instead of the first stage test in the first embodiment, the signal processing system 2 may perform the audio test by selecting any one of audio characteristics out of the audio characteristics 1 to 20 and adjusting head-related transfer functions of the audio characteristics in the first embodiment. If preferred test sounds immediately after completion of the first stage test in the first embodiment are the test sounds 2 and 4, the signal processing system 2 may perform the audio test by adjusting the audio characteristics 2 in the test sound 2. In this case as well, audio characteristics more preferred by a listener than the audio characteristics 2 reflected in the test sound 2 can be determined at the least. Note that, for example, it is preferable that the signal processing system 2 perform at least the first stage test out of the first to third stage tests in the first embodiment to narrow down preferred head-related transfer functions, and then perform the audio test in the second embodiment of adjusting the head-related transfer functions. In this manner, the number of times of adjusting the parameters of head-related transfer functions by the controller 211 can be reduced, and audio characteristics preferred to a listener can be determined with higher efficiency and higher accuracy.

Third Embodiment

In the signal processing system 1 described above, the signal processing apparatus 20 outputs test sounds to a listener from the audio signal output unit 205 via the headphones 30. However, space inverse filtering processing may be performed so that test sounds may be output to a listener from an audio signal output unit 207 via speakers 31, as in a signal processing apparatus 22 of a signal processing system 3 according to the third embodiment.

The signal processing system 3 according to the third embodiment will be described below with reference to FIG. 5. Note that, for the sake of description, components having functions the same as the functions of the components described in the embodiments described above are denoted by the same reference signs, and description thereof will be herein omitted.

Signal Processing System 3

Figure 5:
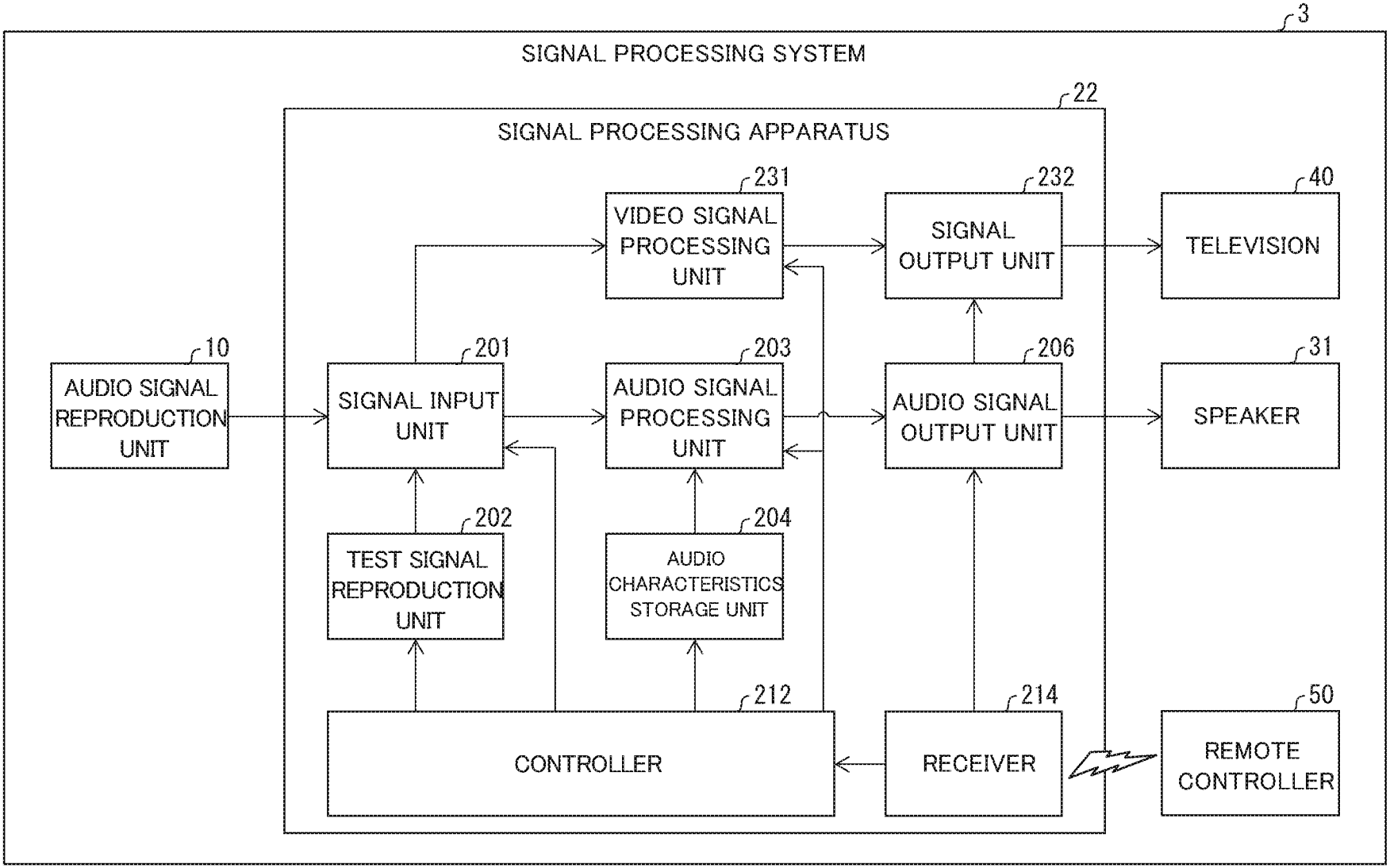
FIG. 5 is a block diagram illustrating a configuration example of a signal processing system according to a third embodiment of the present invention.

FIG. 5 is a block diagram illustrating a main configuration of the signal processing system 2 according to the second embodiment. As illustrated in FIG. 5, the signal processing system 3 according to the third embodiment includes a signal processing apparatus 22 and a plurality of speakers 31 instead of the signal processing apparatus 20 and one or more headphones 30. Other than these configurations, the signal processing system 3 has the same configuration as the configuration of the signal processing system 1. As the speakers 31, publicly known speakers can be used, and thus description thereof will be herein omitted. The signal processing system 3 including the signal processing apparatus 22 is a system for implementing a technique (transaural reproduction technique) for achieving sound localization at localization positions where speakers do not actually exist.

Signal Processing Apparatus 22

The signal processing apparatus 22 includes a controller 212 instead of the controller 210. Other than these configurations, the signal processing apparatus 22 has the same configuration as the configuration of the signal processing apparatus 20.

Audio Signal Processing Unit 203

The audio signal processing unit 203 makes test sounds reflect predetermined head-related transfer functions and space inverse filters associated with respective reflectances of a plurality of assumed floor surfaces. It is herein assumed that the predetermined head-related transfer functions are capable of providing a specific sense of localization to test sounds. When the space inverse filters are appropriate filters, a listener can recognize that the test sounds have a specific sense of localization. The controller 212 causes the audio signal processing unit 203 to generate a plurality of test sounds made to reflect a plurality of types of respective space inverse filters associated with respective reflectances of a plurality of assumed floor surfaces.

Here, the space inverse filters are easily subject to the influence of a space of installation. For example, sound localization at a desired localization position may not be achieved due to the influence of reflection on floor surfaces. Paths of test sounds propagating to a listener with reflection on floor surfaces can be assumed by measuring positions of a listener and the speakers 31 by using a tape measure or the like. Thus, the controller 212 can calculate a period of time taken by the test sounds to reach the listener with reflection on floor surfaces, but cannot measure reflectances of the floor surfaces. To measure reflectances of floor surfaces, measurement needs to be carried out in an anechoic room and a reverberation room, and it is difficult to carry out measurement in general environments. Reflectances of floor surfaces significantly differ depending on surface finish conditions of the floor, that is, materials, smoothness, whether or not a carpet is laid, and if a carpet is laid, the depth of fibers or the like. As described above, measuring reflectances of floor surfaces is not easy, and simply using assumed space inverse filters may not result in achieving localization at a desired position.

In contrast, owing to the controller 212, the signal processing apparatus 22 according to the present embodiment can select appropriate space inverse filters according to selection of a listener out of a plurality of types of space inverse filters. In this manner, even if reflectances of floor surfaces cannot be measured, sound localization at a desired position can be achieved.

Controller 212

In addition to the function of the controller 210, the controller 212 is further provided with the following function. The controller 212 prompts a listener to select a test sound having a specific sense of localization out of the test sounds output via the plurality of space inverse filters 208. For example, in one aspect, the controller 212 prompts a listener to select a test sound that is located at a position outside of the head. Alternatively, in another aspect, the controller 212 prompts a listener to select a test sound that is located in a predetermined direction (for example, behind) outside of the head. Alternatively, in another aspect, the controller 212 prompts a listener to select a test sound that is located in a predetermined direction (for example, behind) outside of the head. In another aspect, when the same test sounds are located at a plurality of localization positions, the controller 210 prompts the listener to select a test sound according to a relation of the localization positions among the same test sounds (for example, imbalance in the localization positions in the test sounds or distances between the localization positions in the test sounds) out of the above-mentioned plurality of test sounds.

Then, the receiver 214 receives results of the selection made by the listener. In this manner, the controller 212 can narrow down to reflectances close to actual reflectances of floor surfaces by having the listener select a test sound having a specific sense of localization out of the test sounds made to reflect a plurality of space inverse filters. As a result, the controller 212 can select space inverse filters according to reflectances close to actual reflectances of floor surfaces out of a plurality of space inverse filters and control the audio signal processing unit 203 so that the audio signal processing unit 203 processes input signals by using the selected space inverse filters.

In one aspect, the audio signal processing unit 203 includes space inverse filters associated with candidates for assumed reflectances of floor surfaces, and the controller 212 selects preferred space inverse filters out of these. For example, it is herein assumed that the most preferred test sound immediately after completion of the third stage test according to the first embodiment is the test sound 2 according to the first embodiment, and assumed reflectances of floor surfaces are reflectances A. In this case, the controller 212 adjusts parameters of the reflectances A, and calculates reflectances A' higher than the reflectances A and reflectances A" lower than the reflectances A. Then, the controller 212 causes the audio signal processing unit 203 to apply space inverse filters associated with the reflectances A' and space inverse filters associated with the reflectances A" to audio signals input to the audio signal processing unit 203. The controller 212 prompts the listener to make a selection as to which test sound through which space inverse filters is located at the localization position, and the receiver 214 receives results of the selection made by the listener. The controller 212 selects preferred space inverse filters, based on the results of the selection made by the listener that are acquired from the receiver 214. In this manner, the controller 212 repeats the operation of adjusting reflectances and prompting the listener to select which space inverse filters according to which reflectances out of these are preferable. In this manner, a range of assumed reflectances of floor surfaces can be narrowed down without measuring the reflectances of the floor surfaces. As a result, narrowing down to more preferred space inverse filters according to reflectances close to actual reflectances of floor surfaces can be implemented.

Implementation Example by Software

Control blocks of the signal processing apparatuses 20 to 22 of the signal processing systems 1 to 3 (in particular, the audio signal processing unit 203, the audio signal output units 205 to 207, the controllers 210 to 212, and the receiver 214) may be implemented by logic circuits (hardware) formed in integrated circuits (IC chips) and the like, or may be implemented by software.

In the latter case, the signal processing apparatuses 20 to 22 are provided with a computer that executes commands of a signal processing program, which is software for implementing each function. The stated computer includes at least one processor (control device), for example, and includes at least one computer-readable recording medium having stored the signal processing program therein. In the computer, the processor reads out the signal processing program from the recording medium and executes the signal processing program, thereby accomplishing the object of the disclosure. For example, a Central Processing Unit (CPU) may be used as the processor. As the recording medium, a "non-transitory tangible medium" such as a tape, a disk, a card, a semiconductor memory, and a programmable logic circuit may be used in addition to a Read Only Memory (ROM). Additionally, a Random Access Memory (RAM) on which the signal processing program is loaded, or the like may be further provided. The signal processing program may be supplied to the computer via any transmission medium (communication network, broadcast wave, or the like) capable of transmitting the signal processing program. Note that an aspect of the present invention may be implemented in a form of data signal embedded in a carrier wave, which is embodied by electronic transmission of the signal processing program.

Supplement

Signal processing apparatuses 20 to 22 according to the first aspect of the present invention include: an output unit (audio signal output units 205 to 207) configured to output a plurality of test sounds in a superimposed manner; a selection processing unit (controllers 210 to 212) configured to prompt a listener to select a test sound having a specific sense of localization out of the plurality of test sounds; an acquisition unit (receiver 214) configured to acquire results of the selection made by the listener; and an audio signal processing unit 203 configured to perform audio signal processing associated with the results of the selection on an input signal.

According to the configuration described above, characteristics in sound localization processing preferred by a listener can be easily determined.

In the signal processing apparatus according to the second aspect of the present invention, in the first aspect, the test sound having the specific sense of localization may be a test sound located behind a head.

According to the configuration described above, characteristics in sound localization processing preferred by the listener can be more easily determined.

In the signal processing apparatus according to the third aspect of the present invention, in the first aspect, the test sound having the specific sense of localization may be a test sound located outside of a head.

According to the configuration described above, characteristics in sound localization processing preferred by the listener can be more easily determined.

In the signal processing apparatus according to the fourth aspect of the present invention, in the first aspect, the test sound having the specific sense of localization may be a test sound located at specific height.

According to the configuration described above, characteristics in sound localization processing preferred by the listener can be more easily determined.

In the signal processing apparatus according to the fifth aspect of the present invention, in the first aspect, the test sound having the specific sense of localization may be a test sound located at a plurality of positions.

According to the configuration described above, characteristics in sound localization processing preferred by the listener can be more easily determined.

In the signal processing apparatus according to the sixth aspect of the present invention, in any one of the first to fifth aspects, the output unit may output a first plurality of test sounds in a superimposed manner, the selection processing unit may prompt the listener to select a test sound having a first sense of localization out of the first plurality of test sounds, the acquisition unit may acquire first results of the selection made by the listener, the output unit may output a second plurality of test sounds associated with the first results of the selection in a superimposed manner, the selection processing unit may prompt a listener to select a test sound having a second sense of localization out of the second plurality of test sounds, the acquisition unit may acquire second results of the selection made by the listener, and the audio signal processing unit may perform audio signal processing associated with the second results of the selection on the input signal.

According to the configuration described above, characteristics in sound localization processing more preferred by a listener can be easily determined.

In the signal processing apparatus according to the seventh aspect of the present invention, in any one of the first to sixth aspects, the audio signal processing unit may convolve the input signal with head-related transfer functions associated with the results of the selection.

According to the configuration described above, compatibility between characteristics in sound localization processing such as head-related transfer functions and test sounds can be made to have a smaller impact on the effects as to how the sound is heard, and preferred characteristics in sound localization processing can be determined with higher accuracy.

In the signal processing apparatus according to the eighth aspect of the present invention, in any one of the first to sixth aspects, the audio signal processing unit may apply a space inverse filter associated with the results of the selection to the input signal.

According to the configuration described above, the signal processing apparatus can implement a technique (transaural technique) for achieving sound localization at localization positions where speakers do not actually exist can be achieved without the use of a sound output apparatus (headphones) in a similar manner to the case where a sound output apparatus is used.

In the signal processing apparatus according to the ninth aspect of the present invention, in any one of the first to eighth aspects, the plurality of test sounds may be different from one another in at least one of a tone color, a scale, a tone sequence pattern, and a localization position, and the acquisition unit may detect input of a tone color, a scale, a tone sequence pattern, or a localization position from the listener, and acquire a test sound associated with the detected input as results of the selection.

According to the configuration described above, a test sound can be easily perceived through the use of a tone color, a scale, a tone sequence pattern, or a localization position.

A signal processing system (1 to 3) according to the tenth aspect of the present invention includes: the signal processing apparatus according to any one of the first to ninth aspects; a sound output apparatus (headphones 30) configured to output the plurality of test sounds and sound of the input signal having been subjected to the audio signal processing; and a display device (television 40), wherein the selection processing unit causes the display device to display an image used to prompt a listener to select a test sound having a specific sense of localization out of the plurality of test sounds.

According to the configuration described above, effects similar to the effects of the signal processing apparatus according to one aspect of the present invention are produced.

A signal processing method according to the eleventh aspect of the present invention includes: an output step of using a signal processing apparatus to output a plurality of test sounds in a superimposed manner; a selection processing step of using the signal processing apparatus to prompt a listener to select a test sound having a specific sense of localization out of the plurality of test sounds; an acquisition step of using the signal processing apparatus to acquire results of the selection made by the listener; and an audio processing step of using the signal processing apparatus to perform audio signal processing associated with the results of the selection on an input signal.

According to the configuration described above, effects similar to the effects of the signal processing apparatus according to one aspect of the present invention are produced.

The signal processing apparatus according to each aspect of the invention may be implemented by a computer. In this case, a control program for the signal processing apparatus which causes the computer to function as each unit (software module) included in the signal processing apparatus and a computer-readable recording medium storing the control program fall within the scope of the invention.

The present invention is not limited to each of the above-described embodiments. It is possible to make various modifications within the scope of the claims. An embodiment obtained by appropriately combining technical elements each disclosed in different embodiments falls also within the technical scope of the present invention. Furthermore, technical elements disclosed in the respective embodiments may be combined to provide a new technical feature.

The invention claimed is:

1. A signal processing apparatus comprising:

an output unit configured to output a plurality of test sounds in a superimposed manner;

a selection processing unit configured to prompt a listener to select a test sound having a specific sense of localization out of the plurality of test sounds;

an acquisition unit configured to acquire results of the selection made by the listener; and an audio signal processing unit configured to perform audio signal processing associated with the results of the selection on an input signal.

2. The signal processing apparatus according to claim 1, wherein the test sound having the specific sense of localization is a test sound located behind a head.

3. The signal processing apparatus according to claim 1, wherein the test sound having the specific sense of localization is a test sound located outside of a head.

4. The signal processing apparatus according to claim 1, wherein the test sound having the specific sense of localization is a test sound located at specific height.

5. The signal processing apparatus according to claim 1, wherein the test sound having the specific sense of localization is a test sound located at a plurality of positions.

6. The signal processing apparatus according to claim 1, wherein the output unit outputs a first plurality of test sounds in a superimposed manner, the selection processing unit prompts the listener to select a test sound having a first sense of localization out of the first plurality of test sounds, the acquisition unit acquires first results of the selection made by the listener, the output unit outputs a second plurality of test sounds associated with the first results of the selection in a superimposed manner, the selection processing unit prompts a listener to select a test sound having a second sense of localization out of the second plurality of test sounds, the acquisition unit acquires second results of the selection made by the listener, and the audio signal processing unit performs audio signal processing associated with the second results of the selection on the input signal.

7. The signal processing apparatus according to claim 1, wherein the audio signal processing unit convolves the input signal with head-related transfer functions associated with the results of the selection.

8. The signal processing apparatus according to claim 1, wherein the audio signal processing unit applies a space inverse filter associated with the results of the selection to the input signal.

9. The signal processing apparatus according to claim 1, wherein the plurality of test sounds are different from one another in at least one of a tone color, a scale, a tone sequence pattern, and a localization position, and the acquisition unit detects input of a tone color, a scale, a tone sequence pattern, or a localization position from the listener, and acquires a test sound associated with the detected input as results of the selection.

10. A signal processing system comprising:

the signal processing apparatus according to claim 1;

a sound output apparatus configured to output the plurality of test sounds and sound of the input signal having been subjected to the audio signal processing; and a display device, wherein the selection processing unit causes the display device to display an image used to prompt a listener to select a test sound having a specific sense of localization out of the plurality of test sounds.

11. A signal processing method comprising:

an output step of using a signal processing apparatus to output a plurality of test sounds in a superimposed manner;

a selection processing step of using the signal processing apparatus to prompt a listener to select a test sound having a specific sense of localization out of the plurality of test sounds;

an acquisition step of using the signal processing apparatus to acquire results of the selection made by the listener; and an audio processing step of using the signal processing apparatus to perform audio signal processing associated with the results of the selection on an input signal.

12. A non-transitory computer-readable recording medium recording a signal processing program for causing a computer to function as the signal processing apparatus according to claim 1.

* * * * *